US006970569B1

(12) United States Patent
Yamada

(10) Patent No.: US 6,970,569 B1
(45) Date of Patent: Nov. 29, 2005

(54) AUDIO PROCESSING APPARATUS AND AUDIO REPRODUCING METHOD

(75) Inventor: Yuji Yamada, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/429,986

(22) Filed: Oct. 29, 1999

(30) Foreign Application Priority Data

Oct. 30, 1998 (JP) ..... 10-311308

(51) Int. Cl.[7] ..... H04R 5/02
(52) U.S. Cl. ..... 381/310; 381/17; 381/63
(58) Field of Search ..... 381/1, 17, 309, 381/310, 61, 63

(56) References Cited

U.S. PATENT DOCUMENTS 5,371,799 A * 12/1994 Lowe et al. ..... 381/310
5,381,482 A * 1/1995 Matsumoto et al. ..... 381/1
5,572,591 A * 11/1996 Numazu et al. ..... 381/1
5,742,688 A * 4/1998 Ogawa et al. ..... 381/17
5,761,295 A * 6/1998 Knappe et al. ..... 379/387.02
5,796,845 A * 8/1998 Serikawa et al. ..... 381/1
5,844,816 A * 12/1998 Inanaga et al. ..... 702/145
5,946,400 A * 8/1999 Matsuo ..... 381/17
5,974,152 A * 10/1999 Fujinami ..... 381/1
6,011,851 A * 1/2000 Connor et al. ..... 381/17
6,021,205 A * 2/2000 Yamada et al. ..... 381/310
6,850,621 B2 * 2/2005 Sotome et al. ..... 381/17

* cited by examiner

*Primary Examiner*—Brian T. Pendleton
(74) *Attorney, Agent, or Firm*—Jay H. Maioli

(57) ABSTRACT

An audio processing apparatus that includes a first filter for converting n-channel (n≧1, positive integer) audio signals input from at least one signal source into two-channel signals, a pair of second filters to which two-channel output signals from the first filter means are input and which have transfer functions that are not correlated, and an output unit for supplying a pair of output signals from the pair of second filters to left and right loudspeaker units of a headphone device.

6 Claims, 9 Drawing Sheets

AUDIO PROCESSING APPARATUS AND AUDIO REPRODUCING METHOD

BACKGROUND OF THE INVENTION

1. Field of the Invention

The present invention relates to an audio processing apparatus suitably applied to reproduce a stereo audio signal by a headphone device and an audio reproducing method applied to the audio processing apparatus.

2. Description of the Related Art

In recent years, as an audio signal (an aural signal) in accompany with a video image of a movie or the like, a multi-channel signal is frequently used which is recorded on the assumption that it is reproduced by loudspeakers placed on both the sides of the video image and the center of the video image and a loudspeaker or the like placed behind an audience or loudspeakers placed on both the sides of the audience. As a result, a sound source in the video image coincides with the position of a sound image which is actually heard, and a sound field having more natural spread is established.

However, when such a sound is to be appreciated by using a conventional headphone device, an acoustic image obtained by an audio input is localized in a head, and the position of the video image does not coincide with the localization position of the sound image. As a result, the sound image is very unnaturally localized. In addition, the focal position of an audio signal of each channel cannot be separately and independently reproduced. As a matter of course, when only multi-channel sound such as a music or the like is appreciated, unlike reproduction by loudspeakers, a sound is heard from the inside of a head, and the focal positions of the sound image is not separated. A very unnatural sound field is reproduced.

When the sound is heard by a headphone device to improve this phenomenon, in order to obtain a sound field equivalent to that obtained by reproduction by loudspeakers, the following method may be considered. That is, transfer functions from loudspeakers arranged for respective channels in advance to both the ears of a listener are measured or calculated, and these functions are superposed on audio signals by filters such as digital filters or the like. Thereafter, the sound is heard by the headphone device.

FIG. 11 is a block diagram showing a conventional headphone device to which this method is applied. Two left- and right-channel stereo audio signals obtained from input terminals 1L and 1R are converted into digital audio signals by analog/digital converters 2L and 2R, respectively. Two left- and right-channel audio signals output from the analog/digital converters 2L and 2R are supplied to a digital processing circuit 3. The digital processing circuit 3 is constituted by a plurality of digital filters 3LL, 3LR, 3RL, and 3RR and two adders 4L and 4R, and is a circuit which performs a process of performing conversion such that a reproduced sound field similar to a reproduced sound field obtained when loudspeaker units are actually arranged indoor or the like can be obtained by a headphone device (so-called process of converting stereophonic sound into binaural sound).

As a concrete configuration of the digital processing circuit 3, the following configuration is used. That is, the left-channel audio signal is supplied to the first digital filter 3LL and the second digital filter 3LR, while the right-channel audio signal is supplied to the third digital filter 3RL and the fourth digital filter 3RR. Each of the digital filters has the configuration shown in FIG. 12, for example. The digital filter shown in FIG. 12 is an FIR type filter in which a signal obtained at an input terminal 81 is supplied to delay circuits 82*a*, 82*b*, . . . , 82*m*, and 82*n* which are continuously connected to each other in a plurality of stages. The signal obtained at the input terminal 81 and output signals from the respective delay circuits 82*a* to 82*n* are supplied to separate coefficient multipliers 83*a*, 83*b*, . . . , 83*n*, and 83*o*, respectively, in which the signals are multiplied by coefficient values which are independently set, respectively, and the multiplication signals are sequentially added to each other by adders 84*a*, 84*b*, . . . , 84*m*, and 84*n*. An output obtained by adding all the coefficient multiplication signals is obtained at an output terminal 85.

An output from the first digital filter 3LL constituted by the digital filter having the configuration described above and an output from the third digital filter 3RL are supplied to the adder 4L to be added to each other, and a conversion output for the left channel is obtained. An output from the second digital filter 3LR and an output from the fourth digital filter 3RR are supplied to the adder 4R to be added to each other, and a conversion output for the right channel is obtained.

The left-channel output obtained by addition performed in the adder 4L is supplied to a digital/analog converter 5L to be converted into an analog audio signal. The converted analog audio signal is amplified by an amplification circuit 6L for driving a headphone device, and then supplied to a left-ear loudspeaker unit 7L of a headphone device 7. Also, the right-channel output obtained by addition performed in the adder 4R is supplied to a digital/analog converter 5R to be converted into an analog audio signal. The converted analog audio signal is amplified by a amplification circuit 6R by an amplification circuit 6R for driving a headphone device, and then supplied to a right-ear loudspeaker unit 7R of the headphone device 7.

In this case, in the process in the digital processing circuit 3, a principle that an audio signal for stereophonic reproduction is converted into an audio signal for binaural reproduction will be described below with reference to FIG. 13. An left-channel loudspeaker unit SL is arranged in front of a listener on the left, and a right-channel loudspeaker unit SR is arranged in front of the listener on the right, so that audio signals for stereophonic reproduction can be reproduced from the respective loudspeakers. At this time, assumed that, of sounds reaching the left ear of the listener, a sound reaching the left ear from the left-channel loudspeaker unit SL of the left channel has a transfer function HLL, and a sound reaching the left ear from the right-channel loudspeaker unit SR of the right channel has a transfer function HRL. In addition, assume that, of sounds reaching the right ear of the listener, a sound reaching the right ear from the right-channel loudspeaker unit SR of the right channel has a transfer function HRR, and a sound reaching the right ear from the left-channel loudspeaker unit SL has a transfer function HLR.

The coefficient values of the coefficient multipliers of the respective digital filters are set such that the four transfer functions HLL, HLR, HRL, and HRR are reproduced by arithmetic processes performed in the four digital filters 3LL, 3LR, 3RL, and 3RR, so that two-channel audio signals for stereophonic reproduction are converted into two-channel audio signals for binaural reproduction. In this case, the coefficient values set in the coefficient multipliers of the digital filters respectively are set on the basis of measurement values obtained by measuring the transfer functions of impulse responses from the loudspeaker units of the respective channels to both the ears in a live room.

According to the processing apparatus proposed as described above, a sound image is localized outside the head of the listener. However, in order to give a sufficient sense of distance to the localized sound image, when the transfer functions from the loudspeakers of the respective channels to both the ears are measured, the transfer functions must be obtained as data having long reverberation times. In order to set the data having long reverberation times in the digital filters, digital filters required by the conventional digital processing circuit 3 having the configuration shown in FIG. 11 have very-large-scale configurations. More specifically, each of the four digital filters required by the digital processing circuit 3 is constituted by approximately 1000 delay circuits connected in series with each other, approximately 1000 coefficient multipliers for multiplying outputs from the respective delay circuits by coefficient values, and approximately 1000 adders for adding multiplication outputs from the respective coefficient multipliers. The digital filters must be caused to perform processes by using transfer functions having reverberation times, and hence the circuit scales of the digital filters are very large. Therefore, quantities of arithmetic processing increase.

The process of converting two-channel audio signals into audio signals for binaural reproduction is described here. However, when multi-channel audio signals having many channels such as four-channel audio signals for reproducing a sound field which surrounds a listener are converted into audio signals for binaural reproduction, a further large number of digital filters are required, and the circuit configuration disadvantageously has a very large scale.

SUMMARY OF THE INVENTION

The present invention has been made in consideration of the above points, and has as its object to provide an audio processing apparatus and an audio reproducing method which can realize a localization of a sound image with a sufficient sense of distance at an arbitrary position for a listener of a headphone device while suppressing a quantity of arithmetic processing of an impulse response.

An audio processing apparatus according to the present invention comprises a first filter means for converting an n-channel ($n \geqq 1$, positive integer) audio signal input from at least one sound source into two-channel signals, a pair of second filter means to which a pair of output signals from the first filter means are input and in which transfer functions have uncorrelation, and an output unit for supplying a pair of output signals from the pair of second filter means to left and right loudspeaker units of a headphone.

According to this audio processing apparatus, an arithmetic process of an impulse response is performed by the first filter means, the process of adding reflective sound components having transfer functions which are not correlated to each other on the left and right to the two-channel signals converted into audio signals for reproduction of a headphone by the arithmetic operation of the impulse response is performed by the second filter means, and a localization of a sound acoustic image can be realized at an arbitrary position with a sufficient sense of distance.

In an audio reproducing method according the present invention, a first conversion process of converting an n-channel ($n \geqq 1$, positive integer) audio signal input from at least one sound source into two-channel signals on the basis of two series of impulse responses from a sound source to left and right ears of a listener and a second conversion process of independently performing reflective sound adding processes by uncorrelated transfer functions for a pair of signals obtained by the first conversion process are performed, and a pair of signals subjected to the second conversion process are reproduced near the left ear and the right ear of the listener.

According to the audio reproducing method, as a sound field formed by audio signals reproduced near the left ear and the right ear of the listener, a sound field in which a sound image is localized at an arbitrary position on the basis of the arithmetic operation of the impulse responses in the first conversion process can be obtained. By the second conversion process, a localization of a sound image can be realized at an arbitrary position with a sufficient sense of distance.

DETAILED DESCRIPTION OF THE PREFERRED EMBODIMENT

Figure 1:
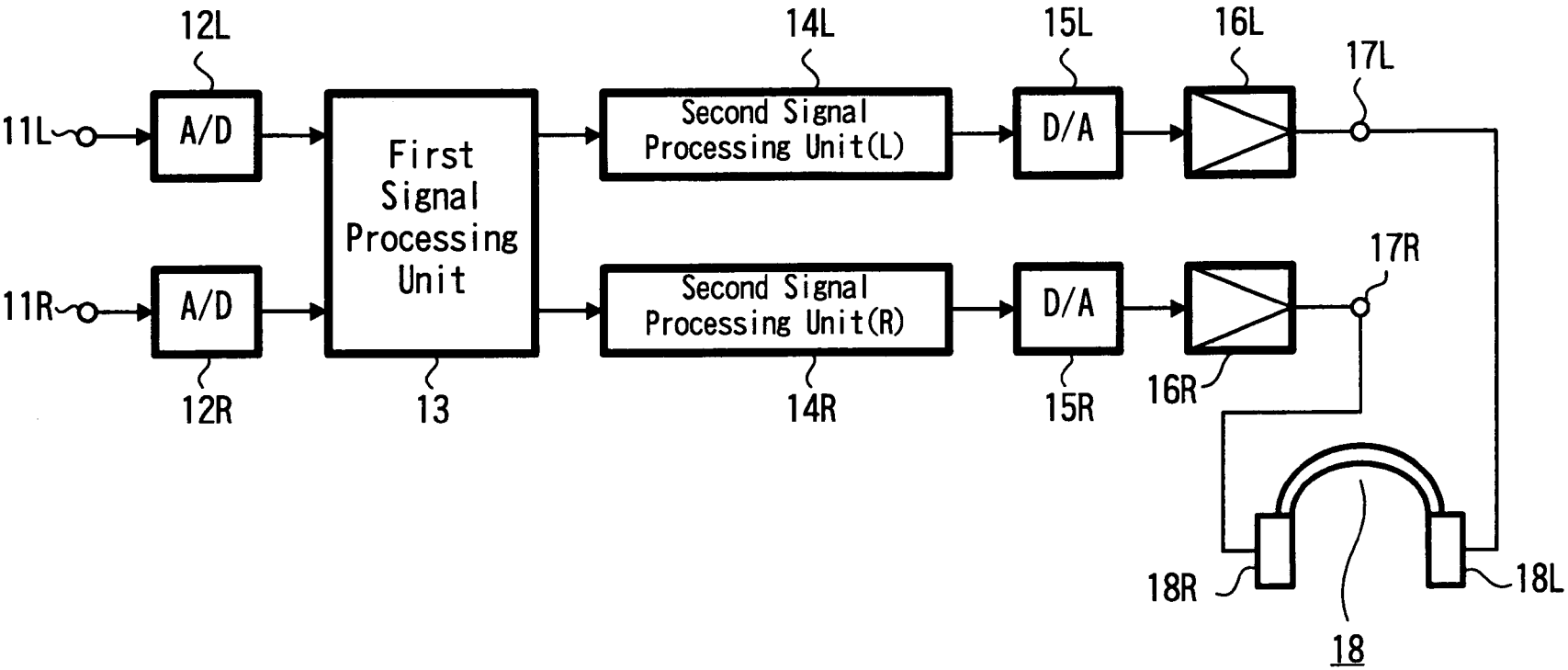
FIG. 1 is a block diagram showing an entire configuration according to a first embodiment of the present invention.

In this embodiment, audio signals for a stereophonic reproduction obtained from input terminals 11L and 11R are converted into audio signals for binaural reproduction, and the audio signals are supplied to a headphone device connected to this apparatus to reproduce the audio signals. FIG. 1 is a block diagram showing an entire configuration of this embodiment. In this configuration, a left-channel signal and a right-channel signal constituting two-channel audio signals for the stereophonic reproduction are supplied to a left-channel audio signal input terminal 11L and a right-channel audio signal input terminal 11R, respectively. Audio signals obtained at the terminals 11L and 11R are converted into digital audio signals by analog/digital converters 12L and 12R for the respective channels.

The converted audio signals of the respective channels are supplied to a first signal processing unit 13. The first signal processing unit 13 is a circuit for performing the process of converting audio signals into two-channel audio signals for forming a sound field for a headphone reproduction on the basis of two series of impulse responses from a sound source to left and right ears of a listener.

Figure 2:
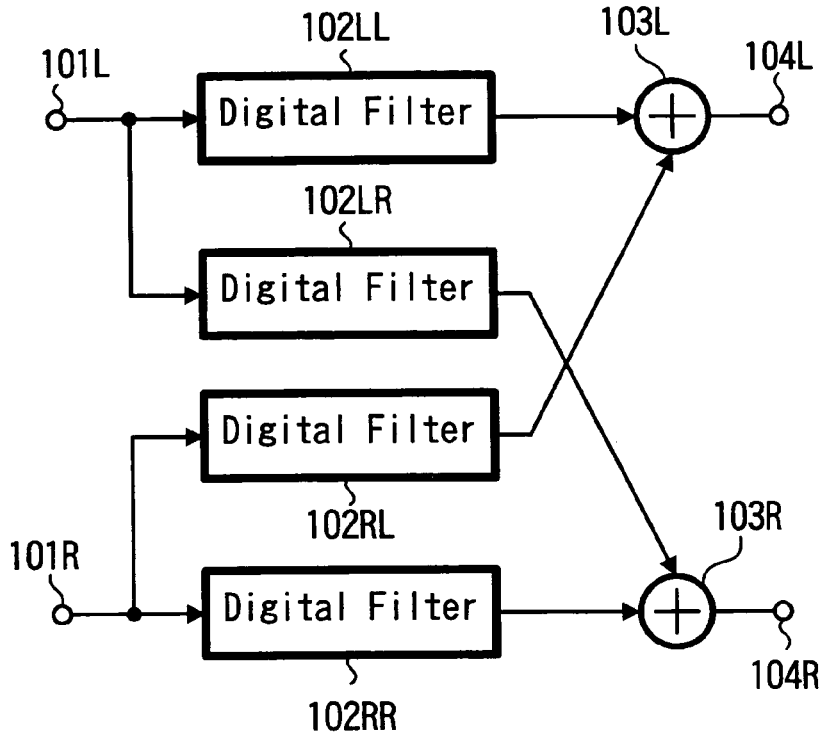
FIG. 2 is block diagram showing a configuration (Configuration 1) of a first signal processing unit according to the first embodiment of the present invention.

FIG. 2 is a block diagram showing a configuration of the first signal processing unit 13, in which a left-channel audio signal obtained at a left-channel signal input terminal 101L of the first signal processing unit 13 is supplied to a first digital filter 102LL and a second digital filter 102LR, while a right-channel audio signal obtained at a right-channel signal input terminal 101R is supplied to a third digital filter 102RL and a fourth digital filter 102RR.

Figure 12:
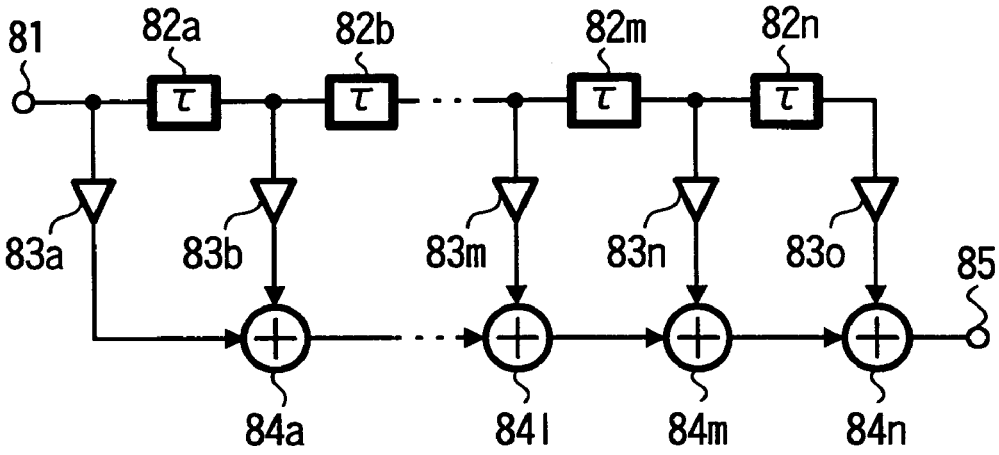
FIG. 12 is a configuration diagram showing a digital filter.

As each of the digital filters 102LL, 102LR, 102RL, and 102RR, a filter having the same configuration as that of the FIR type digital filter shown in FIG. 12 as a prior art is basically used. Coefficient values multiplied in the coefficient multipliers of the respective digital filters are set on the basis of actually measured values of the two series of impulse responses from the sound source to the left and right ears of the listener. In case of this embodiment, however, coefficient values each of which has a quantity of arithmetic processing is considerably smaller than that of a conventional coefficient value is used. For example, a digital filter having the following configuration is used. Approximately 250 delay circuits are connected in series with each other, delay outputs from the approximately 250 delay circuits are independently multiplied by coefficients, and the multiplication values are sequentially added. The reason why the quantity of arithmetic processing is decreased will be described later.

An output from the first digital filter 102LL and an output from the third digital filter 102RL are supplied to an adder 103L to be one series of signals. An addition output from the adder 103L is supplied to a left-channel output terminal 104L of the first signal processing unit 13. An output from the second digital filter 102LR and an output from the fourth digital filter 102RR are supplied to an adder 103R to be one series of signals. An addition output from the adder 103R is supplied to a right-channel output terminal 104R of the first signal processing unit 13.

Figure 13:
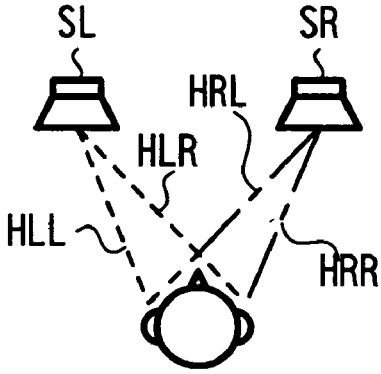
FIG. 13 is an explanatory view for explaining an out-of-head sound image localization process.

The process of converting audio signals into two-channel audio signals for forming a sound field for the headphone reproduction in the first signal processing unit 13 is based on the principle explained by using FIG. 13 in the prior art.

Figure 3:
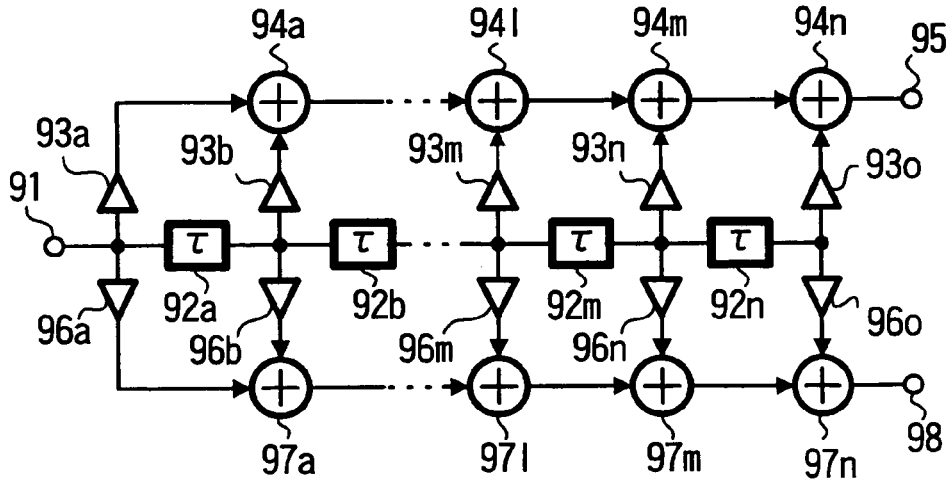
FIG. 3 is a configuration diagram showing an example of a digital filter which can be applied to the first embodiment of the present invention.

As the configuration of digital filters used in the first signal processing unit 13, in place of the configuration using the four digital filters shown in FIG. 2, a configuration using two digital filters shown in FIG. 3 may be used. More specifically, the digital filter shown in FIG. 3 supplies a signal obtained at an input terminal 91 to delay circuits 92*a*, 92*b*, . . . , 92*m*, and 92*n* which are continuously connected to each other in a plurality of stages. A signal obtained at the input terminal 91 and output signals from the delay circuits 92*a*, 92*b*, . . . , 92*m*, and 92*n* are supplied to separate coefficient multipliers 93*a*, 93*b*, . . . , 93*n*, and 93*o*, respectively. The signals are multiplied by coefficient values which are independently set, respectively, and the multiplication signals are sequentially added to each other by adders 94*a*, 94*b*, . . . , 94*m*, and 94*n*. An output obtained by adding all the coefficient multiplication signals is obtained at an output terminal 95. The signal obtained from the input terminal 91 and the output signals from the delay circuits 92*a* to 92*n* are supplied to coefficient multipliers 96*a*, 96*b*, . . . , 96*n*, and 96*o* different from the coefficient multipliers 93*a* to 93*o*, respectively. The signals are multiplied by coefficient values which are independently set, respectively, and the multiplication signals are sequentially added to each other by adders 97*a*, 97*b*, . . . , 97*m*, and 97*n*. An output obtained by adding all the coefficient multiplication signals is obtained at a second output terminal 98.

Two digital filters each having the configuration described above are prepared. One digital filter is used as the filter 102LL and the filter 102LR of the circuit shown in FIG. 2, and the other digital filter is used as the filter 102RL and the filter 102RR. With this configuration, as to at least the delay circuits constituting the digital filters, the number thereof can be made half the number of delay circuits used when four respective digital filters are used.

Figure 4:
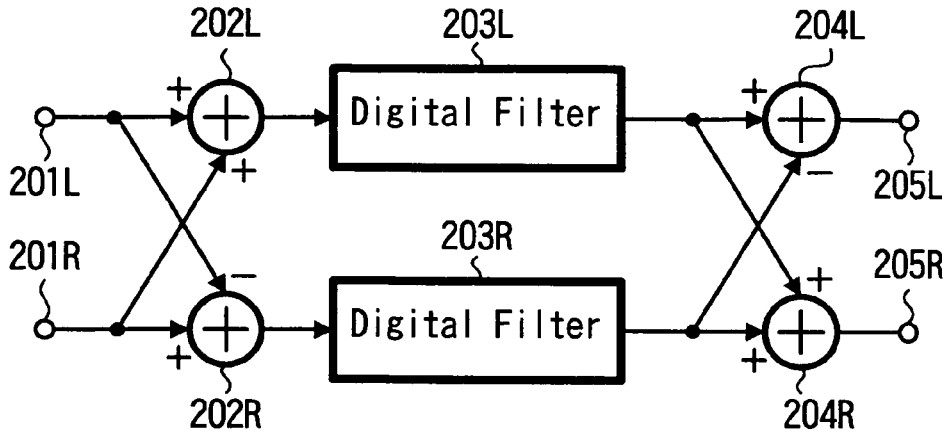
FIG. 4 is a block diagram showing a configuration (Configuration 2) of the first signal processing unit according to the first embodiment of the present invention.

The first signal processing unit 13 shown in FIG. 2 may have a circuit configuration shown in FIG. 4 when the positions of left and right sound sources set by audio signals for the stereophonic reproduction (positions where loudspeakers are actually arranged) are laterally symmetrical positions. More specifically, a left-channel audio signal obtained at a left-channel signal input terminal 201L of the first signal processing unit 13 and a right-channel audio signal obtained at a right-channel signal input terminal 201R are supplied to an adder 202L to be added to each other. The addition signal is supplied to a first digital filter 203L. The left-channel audio signal obtained at the left-channel signal input terminal 201L and the right-channel audio signal obtained at the right-channel signal input terminal 201R are supplied to a subtractor 202R to obtain a value obtained by subtracting the left-channel signal from the right-channel signal. The subtraction signal is supplied to a second digital filter 203R.

As each of the first digital filter 203L and the second digital filter 203R, for example, the FIR type filter shown in FIG. 12 is used. Coefficient values multiplied in the coefficient multipliers of the respective digital filters are set on the basis of actually measured values of two series of impulse responses from the sound sources to the left and right ears of the listener. The number of stages on which the delay circuit, the coefficient multiplier, and the adder are used in each of the digital filters is equal to that of the configuration of each of the digital filters used in the first signal processing unit 13 shown in FIG. 2.

An output from the first digital filter 203L and an output from the second digital filter 203R are supplied to a subtractor 204L to calculate a value obtained by subtracting the output signal from the filter 203R from the output signal from the filter 203L. The subtraction signal is supplied to a left-channel output terminal 205L. The output from the first digital filter 203L and the output from the second digital filter 203R are supplied to an adder 204R to add both the signals, and the addition signal is supplied to a right-channel output terminal 205R.

When the first signal processing unit 13 is constituted by the configuration shown in FIG. 4, the first signal processing unit 13 can be realized by a simple configuration constituted by two digital filters, two adders, and two subtractors. However, the configuration shown in FIG. 4 can be applied only when the positions of left and right sound sources are laterally symmetrical positions.

Returning to the explanation of FIG. 1, the left-channel audio signal processed by the first signal processing unit 13 is supplied to a second signal processing unit 14L for the left channel, and the right-channel audio signal processed by the first signal processing unit 13 is supplied to a second signal processing unit 14R for the right channel. In the second signal processing units 14L and 14R, reflective sound adding processes are independently performed by transfer functions which are not correlated to each other on the left and right.

Figure 6A:
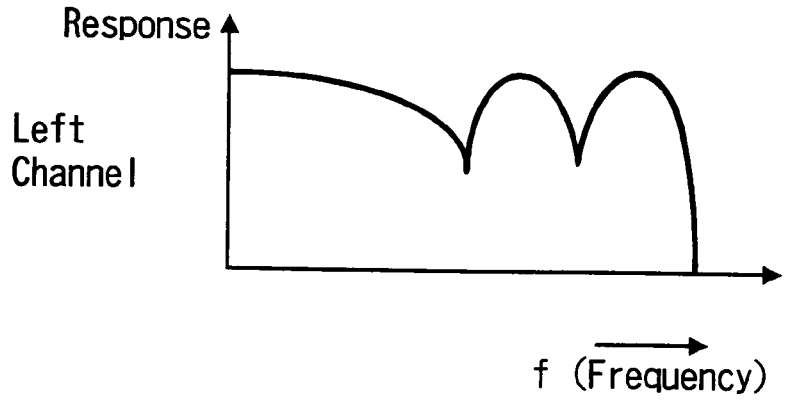
FIGS. 6A and 6B are characteristic graphs showing processes in the second signal processing units according to the first embodiment of the present invention.
Figure 6B:
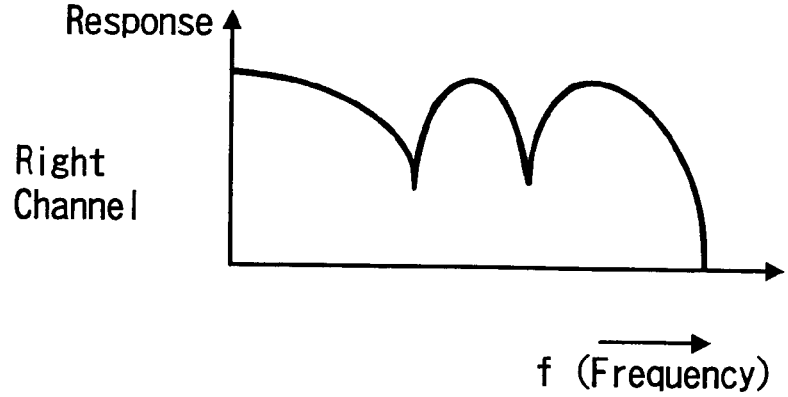

As a concrete configuration of the second signal processing units 14L and 14R, for example, the signal processing units 14L and 14R of the respective channels are formed of independent digital filters. In this case, as each of the digital filters, the FIR type digital filter shown in FIG. 12 is used. In the digital filter of each channel, the following operation process is performed. That is, coefficient values of the respective coefficient multipliers are set by a transfer function which is not correlated to the transfer function of the other channel, and reflective sound components (so-called reverberation sound components) are added on the left and right independently. For example, the frequency characteristics indicated by A in FIG. 6 are set to the left-channel signal, while the frequency characteristics indicated by B in FIG. 6 are set to the right-channel signal, respectively. In case of this embodiment, incidentally, an audio signal is processed as digital data. However, in the characteristic graph in FIG. 6, the frequency characteristics are shown in an analog manner to simplify the explanation.

Figure 5:
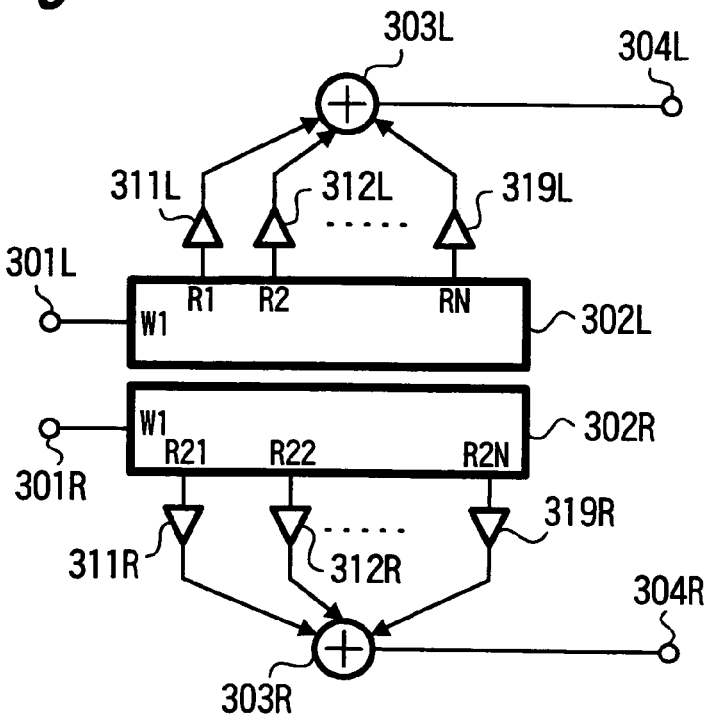
FIG. 5 is a configuration diagram showing a configuration of a second signal processing unit according to the first embodiment of the present invention.

As the configuration of the second signal processing units 14L and 14R, a configuration using digital filters in which delay amounts can be variably set may be used. FIG. 5 shows a case wherein the second signal processing units 14L and 14R are constituted by digital filters constituting variable delay circuits. A left-channel signal obtained at an input terminal 301L is supplied to a first delay circuit 302L, and a right-channel signal obtained at an input terminal 301R is supplied to a second delay circuit 302R. Each of the delay circuits 302L and 302R is a delay circuit which can delay a signal by a maximum of about 50 ms, and which can derive a plurality of signals having arbitrary delay times set within the maximum delay amount. In this case, the delay circuit 302L has a configuration in which an input signal W1 is derived as signals R1, R2, . . . , RN having arbitrary different delay times. The delay circuit 302R has a configuration in which an input signal W1 is derived as signals R21, R22, . . . , R2N having arbitrary different delay times. The number of signals derived from each of the delay circuits 302L and 302R is a relatively small number, i.e., about 10, and settings of positions where the signals are derived (i.e., setting of delay amounts of the signals) are independently performed without correlation on the left and right depending on reflective sound components added to the signals of the respective channels at that time.

The signals R1, R2, . . . , RN extracted from the left-channel delay circuit 302L are multiplied by different coefficient values in different coefficient multipliers 311L, 312L, . . . , 319L, respectively, and the multiplication signals are supplied to an adder 303L to be added to each other. The addition signal is supplied to a left-channel output terminal 304L. The signals R21, R22, . . . , R2N extracted from the right-channel delay circuit 302R are multiplied by different coefficient values in different coefficient multipliers 311R, 312R, . . . , 319R, respectively, and the multiplication signals are supplied to an adder 303R to be added to each other. The addition signal is supplied to a right-channel output terminal 304R. The coefficient values multiplied in the respective coefficient multipliers 311L to 319L and 311R to 319R are fixed values which are predetermined. For example, the level of the signal having a smaller delay amount is increased, and coefficient values are set such that the level gradually decreases in proportion to an increase in delay amount. In place of the fixed values described above, coefficient values multiplied in the coefficient multipliers may be controlled depending on conditions at that time.

When the second signal processing units 14L and 14R are constituted by the configuration shown in FIG. 5, the setting conditions of reflective sound components can be independently varied on the left and right by setting the delay amounts.

Turning back to the configuration in FIG. 1, the left and right audio signals processed by the second signal processing units 14L and 14R are independently supplied to different digital/analog converters 15L and 15R for the respective channels to be converted into analog audio signals. The left and right two-channel analog audio signals therefrom are amplified by amplifiers 16L and 16R, having relatively small amplification factors, for driving a headphone, and the amplified audio signals are then supplied to headphone connection terminals 17L and 17R, respectively. The audio signals of the respective channels obtained from the headphone connection terminals 17L and 17R are supplied to left and right loudspeaker units 18L and 18R of a headphone device 18 connected to the headphone connection terminals 17L and 17R, respectively, and the audio signals are reproduced from the headphone device 18.

With the configuration described above, a sound field reproduced by the headphone device 18 and heard by a listener is a preferable sound field which is similar to a sound field formed such that original two-channel audio signals are reproduced by loudspeakers arranged in a room or the like. In this case, as the process in the first signal processing unit 13 according this embodiment, a process having a relatively small quantity of arithmetic processing is used. For this reason, when signals only processed in the first signal processing unit 13 are supplied to the headphone device, a position where a sound image is localized is a position close to the head of the listener. However, since the process of adding reflective sound components is performed by the second signal processing units 14L and 14R, the sound source can be localized at an arbitrary position with a sufficient sense of distance. In addition, since uncorrelation between the left and right channels is assured in the second signal processing units 14L and 14R, asymmetry of the sound image can be realized, and the forward localization of the sound image is improved.

Figure 11:
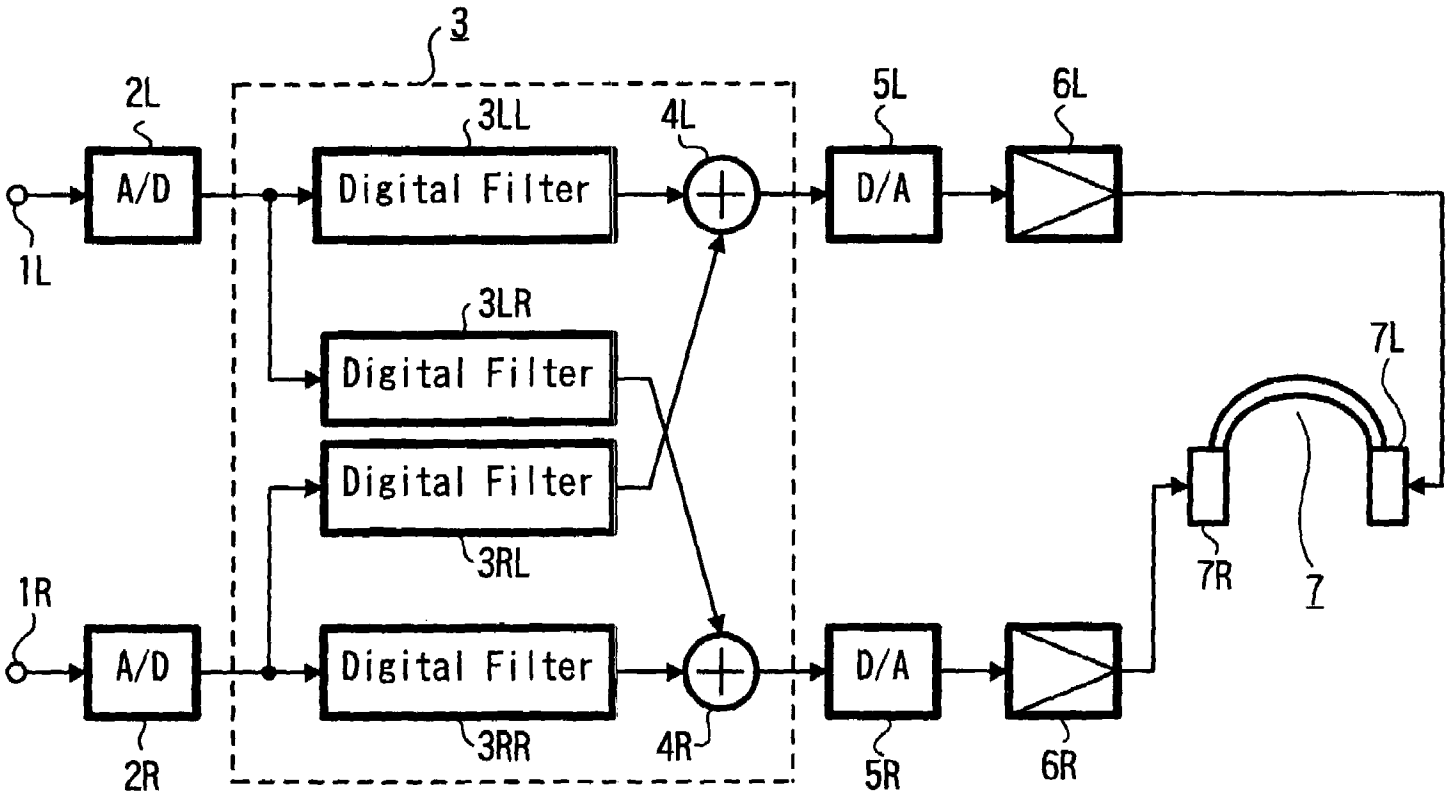
FIG. 11 (PRIOR ART)
FIG. 11 is a block diagram showing a configuration of a conventional audio processing apparatus.

Therefore, as in the case of the processing apparatus shown in FIG. 11 as a prior art, in comparison with a case wherein a conversion process is performed to cause a one-stage digital filter to localize the sound image with a sufficient sense of distance, a circuit configuration can be considerably simplified, and a quantity of arithmetic processing can be reduced. For example, the digital filters constituting the digital processing circuit 3 shown in FIG. 11 must perform delay processes on about 1,000 stages. However, the digital filters constituting the first signal processing unit 13 in the present configuration may perform delay processes on about 250 stages, and the configuration which is ¼ the conventional configuration may be sufficient. In the configuration of this embodiment, although the second signal processing units 14L and 14R are required, the second signal processing units 14L and 14R perform only the process of adding reflective sound components. For this reason, as the second signal processing units 14L and 14R, digital filters having circuit scales which are considerably smaller than those of the digital filters constituting the first signal processing unit 13 are sufficient. When the configuration of this embodiment shown in FIG. 1 is used, the circuit configuration which is considerably simpler than the conventional circuit configuration can be employed.

In the explanation up to this, two-channel audio signals are used as audio signals to be input. However, for example, the following process may be performed. That is, one-channel audio signal is input to the audio signal input terminals 11L and 11R, and the position of a sound image localized by the one-channel signal is set at one arbitrary point.

Figure 7:
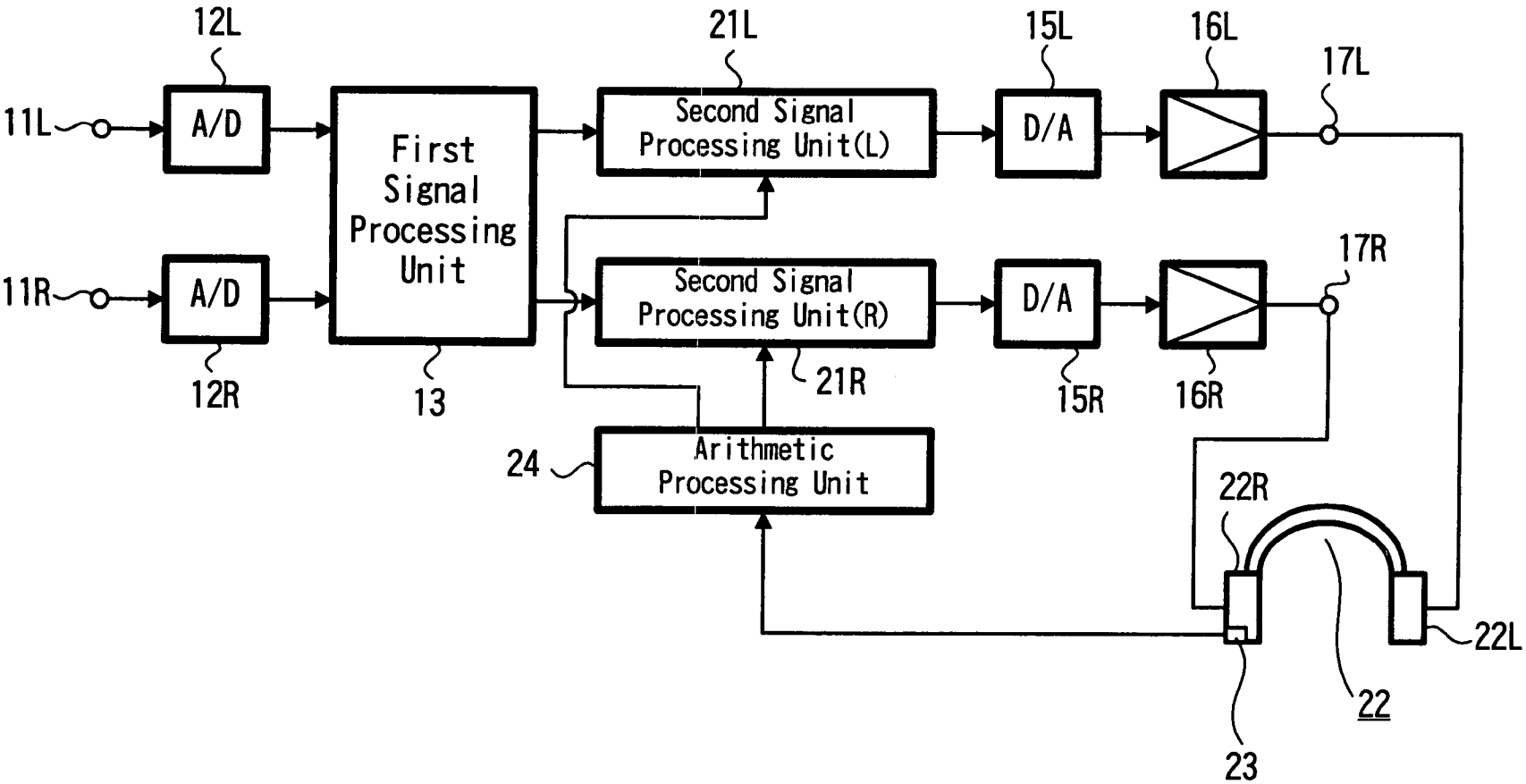
FIG. 7 is a block diagram showing an entire configuration according to a second embodiment of the present invention.
Figure 8:
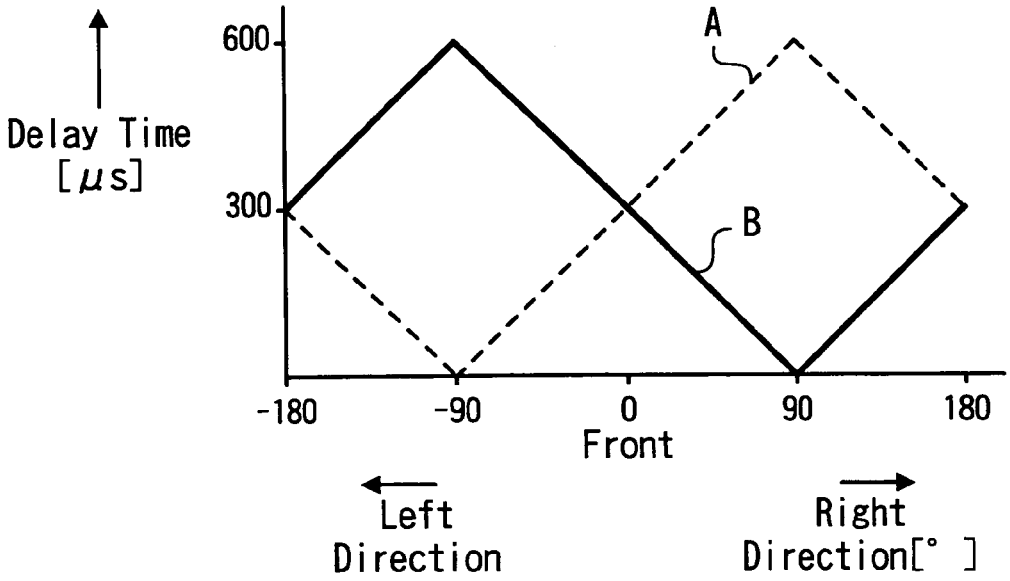
FIG. 8 is a characteristic graph showing the relationship between a change in angle of a listener and a change in delay time according to the second embodiment of the present invention.
Figure 9:
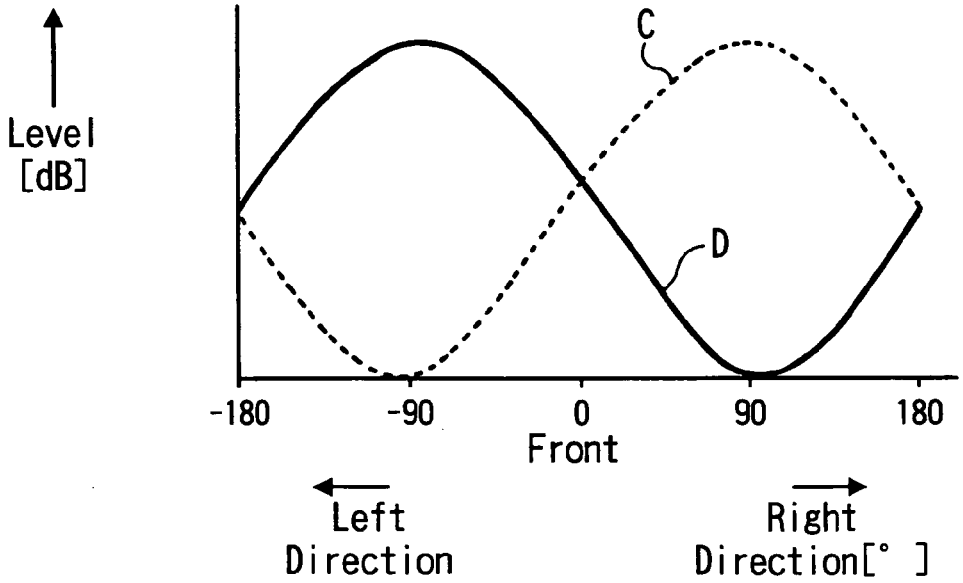
FIG. 9 is a characteristic graph showing the relationship between a change in angle of a listener and a change in level according to the second embodiment of the present invention.

A second embodiment of the present invention will be described below with reference to FIGS. 7 to 9. The same reference numerals as those in FIGS. 1 to 6 explained in the first embodiment described above denote the same parts in FIGS. 7 to 9, and a description thereof will be omitted.

As in this embodiment, too, audio signals for stereophonic reproduction obtained at input terminals 11L and 11R are converted into audio signals for the binaural reproduction, and the converted audio signals are supplied to a headphone device connected to this apparatus to reproduce the audio signals. In this embodiment, the process called a head tracking process of correcting a phase of a sound field is depending on the direction in which the headphone device faces.

The configuration of this embodiment will be described below. FIG. 7 is a block diagram showing the entire configuration of this embodiment. A left-channel signal and a right-channel signal constituting two-channel audio signals for the stereophonic reproduction are supplied to the left-channel audio signal input terminal 11L and the right-channel audio signal input terminal 11R. Audio signals obtained at the terminals 11L and 11R are converted into digital audio signals by analog/digital converters 12L and 12R for the respective channels, and the digital audio signals are then supplied to the first signal processing unit 13. The first signal processing unit 13 is a circuit for performing the process of converting audio signals into two-channel audio signals for forming a sound field for the headphone reproduction on the basis of two series of impulse responses from sound sources to the left and right ears of a listener. This circuit is entirely the same as the circuit which has been described in the first embodiment.

The left-channel audio signal processed by the first signal processing unit 13 is supplied to a second signal processing unit 21L for the left channel, and the right-channel audio signal processed by the first signal processing unit 13 is supplied to a second signal processing unit 21R for the right channel. In the second signal processing units 21L and 21R, reflective sound adding processes are independently performed by transfer functions which are not correlated to each other on the left and right. The circuit configuration of each of the second signal processing units 21L and 21R is the same as that of each of the second signal processing units 14L and 14R described in the first embodiment, and each of them is constituted by, e.g., FIR type digital filters. In this configuration, however, delay amounts set in the signal processing units 21L and 21R are variably set depending on a rotational angle arithmetically processed by a rotational angle arithmetic processing unit 24.

The left and right signals subjected to the reflective sound adding processes by the signal processing units 21L and 21R are respectively supplied to different digital/analog converters 15L and 15R for the respective channels to be converted into analog audio signals. The left and right two-channel analog audio signals are amplified by amplifiers 16L and 16R, having relatively small amplification factors for driving a headphone, and the amplified audio signals are then supplied to headphone connection terminals 17L and 17R. The audio signals of the respective channels obtained from the headphone connection terminals 17L and 17R are supplied to left and right loudspeaker units 22L and 22R of a headphone device 22 connected to the headphone connection terminals 17L and 17R, respectively, and the audio signals are reproduced from the headphone device 22.

In this case, the headphone device 22 according to this embodiment has a configuration including a rotational angular velocity sensor 23 such that a rotational angular velocity parallel to the head of a listener who wears the headphone device 22 is detected. As the rotational angular velocity sensor 23, e.g., a piezoelectric vibration gyro is used. A detection output from the rotational angular velocity sensor 23 is supplied to the rotational angle arithmetic processing unit 24 on the processing apparatus side. The rotational angle arithmetic processing unit 24 is constituted by a microprocessor for arithmetically operating an rotational angle of the headphone device 22 on the basis of the detection output from the rotational angular velocity sensor 23. For example, an output from the rotational angular velocity sensor 23 is subjected to sampling at a constant time interval and then integrated, and the integration result is converted into angle data.

On the basis of the obtained angle data, the process of correcting delay amounts and a level difference used in the processes performed in the second signal processing units 21L and 21R is carried out and a process in which a sound image is localized in a predetermined direction outside the head of the listener wearing the headphone device 22 is performed.

As the process of correcting delay amounts and the level difference set in the respective signal processing units 21L and 21R depending on the detected rotational angle, the following process is performed. That is, depending on the rotational angle of the head of a listener, the multiplication coefficients of the digital filters are updated on real time by control of the rotational angle arithmetic processing unit 24 such that transfer functions corresponding to the rotational angle are realized. In this process, if it is considered that the listener turns her/his head to the right, the sound reaching the left ear becomes earlier than the sound reaching the right ear. In addition, the left ear becomes close to the sound source, while the right ear becomes distant from the sound source. For this reason, the level of the signal reaching the left ear becomes higher than the level of the signal reaching the right ear. When this phenomenon is represented by transfer functions which represents the phenomenon in a pseudo manner, changes in delay tim are as shown in FIG. 8, for example. A characteristic A shown in FIG. 8 indicates a change in delay time added to the right-channel signal depending on an angle, and a characteristic B shown in FIG. 8 indicates a change in delay time added to the left-channel signal depending on an angle. The characteristics A and B are change characteristics of broken lines. In the characteristics obtained by changes in angle, a change in level of the left-channel signal is given by a change indicated by a curve C in FIG. 9, and a change in level of the right-channel signal is given by a change indicated by a curve D in FIG. 9, for example. When the delay amounts and the levels set by the signal processing units 21L and 21R are set depending on the angles as shown in FIGS. 8 and 9, correction depending on the rotational angle of the head of the listener can be performed.

With the configuration described above, similarly as in the first embodiment, a sound field reproduced by the headphone device 22 and heard by the listener is a preferable sound field which is similar to a sound field formed such that original two-channel audio signals are reproduced by loudspeakers arranged in a room or the like. Since the process is performed by the first signal processing unit 13 and the second signal processing units 21L and 21R, similarly as in the first embodiment, the apparatus can be realized by a simple circuit configuration having a small quantity of arithmetic processing. In this embodiment, the correction process in which the sound image is localized in a predetermined direction outside the head of the listener worm with the headphone device is performed simultaneously with the processes in the second signal processing units 21L and 21R. For this reason, as circuits required for the process of correcting the localization direction of the sound image, only the angular velocity attached to the headphone device and the arithmetic operation means for obtaining angle data from the output from the angular velocity sensor may be sufficient. The process of correcting the localization direction of the sound image can be performed by the simple circuit configuration.

By the way, as the means for detecting the direction in which the headphone device 22 faces, the angular velocity sensor is used. However, a configuration in which a geomagnetic sensor for detecting an absolute azimuth is used to cause an output from the geomagnetic sensor to detect the direction may be used.

Figure 10:
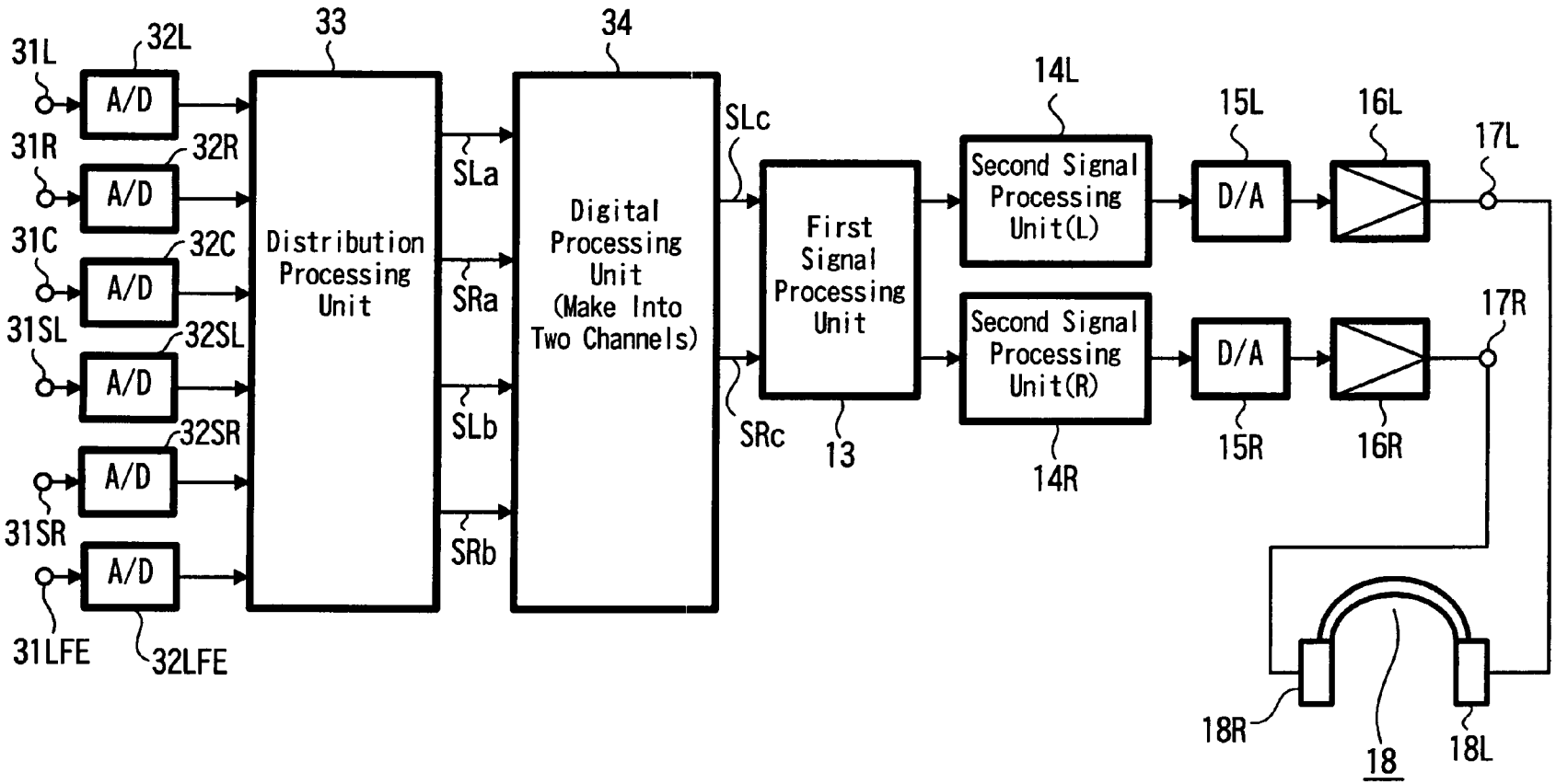
FIG. 10 is a block diagram showing an entire configuration according to a third embodiment of the present invention.

A third embodiment of the present invention will be described below with reference to FIG. 10. The same reference numerals as those in FIGS. 1 to 6 explained in the first embodiment described above denote the same parts in FIG. 10, and a description thereof will be omitted.

In this embodiment, multi-channel audio signals obtained at input terminals 31L, 31R, 31C, 31SL, 31SR, and 31LFE are converted into two-channel audio signals for the binaural reproduction, and the two-channel audio signals are supplied to a headphone device connected to the apparatus to reproduce the two-channel audio signals.

The configuration of this embodiment will be described below. FIG. 10 is a block diagram showing the entire configuration of this embodiment. Multi-channel audio signals supplied to the input terminals of this embodiment are constituted by six-channel audio signals. That is, a left-front-channel signals is obtained at the input terminal 31L, a right-front-channel signal is obtained at the input terminal 31R, and a center-channel signal is obtained at the input terminal 31C. A left-rear-channel signal is obtained at the input terminal 31SL, a right-rear-channel signal is obtained at the input terminal 31SR and a signal of a low-band-only channel is obtained at the input terminal 31LFE. In this channel configuration, the low-band-only channel is considered as a 0.1 channel, and the 0.1 channel and the five remaining channels may be called 5.1 channels in some case. The low-band-only channel is a channel from which only an audio signal in a band lower than, e.g., about 120 Hz can be obtained.

The audio signals obtained at the respective input terminals 31L, 31R, 31C, 31SL, 31SR, and 31LFE are respectively supplied to different analog/digital converters 32L, 32R, 32C, 32SL, 32SR, and 32LFE for the respective channels to be converted into analog audio signals, independently. The converted audio signals of the respective channels are supplied to a distribution processing unit 33. In the distribution processing unit 33, the process of equally mixing the center-channel signal with the signals of left and right front channels is performed, and at the same time the process of equally mixing the signal of the low-band-only channel with the signals of the other channels is performed, so that four-channel signals, i.e., left and right front audio signals SLa and SRa and left and right rear audio signals SLb and SRb are obtained.

The four-channel audio signals are supplied to a digital processing unit 34 to perform the process of converting the two-channel audio signals into audio signals SLc and SRc of left and right two channels having sound sources located at four different positions surrounding a listener. This conversion process is performed by using, e.g., a digital filter, an adder and a subtractor.

The left and right two-channel audio signals SLc and SRc converted by the digital processing unit 34 are supplied to a first signal processing unit 13. The first signal processing unit 13 is a circuit for performing the process of converting audio signals into two-channel audio signals for forming a sound field for the headphone reproduction on the basis of two series of impulse responses from sound sources to the left and right ears of the listener. This circuit is entirely the same as the circuit which has been described in connection with the first embodiment.

The left-channel audio signal processed by the first signal processing unit 13 is supplied to a second signal processing unit 14L for the left channel, and the right-channel audio signal processed by the first signal processing unit 13 is supplied to a second signal processing unit 14R for the right channel. In the second signal processing units 14L and 14R, reflective sound adding processes are independently performed by transfer functions which are not correlated to each other on the left and right. The circuit configuration of the second signal processing units 14L and 14R is the same as that of the second signal processing units 14L and 14R described in connection with the first embodiment.

The left and right signals subjected to the reflective sound adding processes by the signal processing units 14L and 14R are respectively supplied to different digital/analog converters 15L and 15R for the respective channels to be converted into analog audio signals. The left and right two-channel analog audio signals are amplified by amplifiers 16L and 16R, having relatively small amplification factors, for driving a headphone, and the amplified audio signals are supplied to headphone connection terminals 17L and 17R. The audio signals of the respective channels obtained from the headphone connection terminals 17L and 17R are supplied to left and right loudspeaker units 18L and 18R of a headphone device 18 connected to the headphone connection terminals 17L and 17R, respectively, and the audio signals are reproduced from the headphone device 18.

With the configuration described above, a sound field having sound sources located positions surrounding the listener wearing the headphone device 18 is formed the by multi-channel audio signals, and hence the multi-channel audio signals can be preferably reproduced. In this case, similarly as in the first embodiment, since the first signal processing unit 13 and the second signal processing units 14L and 14R are separately arranged, the process of converting signals into signals of a sound field reproduced by a headphone device can be performed by a simple circuit configuration.

This embodiment has explained the process performed when 5.1-channel audio signals are input as multi-channel audio signals. However, the embodiment can also be applied to multi-channel audio signals having another channel configuration as a matter of course.

In addition, when the process of reproducing the multi-channel audio signals is to be performed, it may be possible that the correction process depending on the rotational angle of a head described in the second embodiment is performed, and a position where a sound image is localized always faces in a constant direction even if the head is turned.

In each of the embodiments described up to now, the apparatus for processing supplied audio signals and the headphone device are directly connected to each other with a signal line. However, for example, as a configuration in which audio signals obtained from the output terminals 17L and 18R of the apparatus shown in FIG. 1, FIG. 7, or FIG. 10 are transmitted in wireless to the headphone device through infrared signals or the like, a so-called wireless headphone device in which signals transmitted in wireless are received by a headphone device may be used. In this case, the angular velocity data explained in connection with the second embodiment may be transmitted in wireless to the processing apparatus.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An audio processing apparatus for a headphone comprising:

first filter means for processing n-channel audio signals in accordance with predetermined finite impulse response characteristics including a predetermined limited number of delay stages so as to preclude reflective sound components from being produced and for converting the n-channel (where n is a positive integer greater than or equal to 2) audio signals supplied from at least one signal source into a first channel signal and a second channel signal by mixing processed portions of the n-channel audio signals;

a pair of second filter means, one second filter means having a first predetermined transfer function including reflective sound components and receiving the first channel signal and the other second filter means having a second predetermined transfer function different than said first predetermined transfer function and including reflective sound components and receiving the second channel signal output from the first filter means for providing an uncorrelated independent processing by setting different delay times corresponding to said first and second predetermined transfer functions to the first channel signal and the second channel signal, respectively, wherein the first channel signal remains separate from and unmixed with the second channel signal; and an output unit for respectively supplying signals output from the pair of second filter means to left and right loudspeaker units of the headphone, wherein the pair of second filter means each comprise a digital filter providing uncorrelated independent processing by setting delay times corresponding to the first and second predetermined transfer functions relating to reflective sound components using delay units having different delay times.

2. The audio processing apparatus according to claim 1, wherein the first filter means comprises a pair of digital filters having the same or equivalent transfer characteristics and a plurality of adders for mixing the processed portions of the n-channel audio signals.

3. The audio processing apparatus according to claim 1, further comprising detection means for detecting a rotational movement of the head of a listener wearing the headphone, wherein the uncorrelated processing of the respective predetermined transfer functions in the pair of second filter means is varied depending on an output from the detection means.

4. The audio processing apparatus according to claim 3, wherein the detection means for detecting the rotational of movement of the head of the listener wearing the headphone is a piezoelectric vibration gyro, and the uncorrelated processing corresponding to the respective predetermined transfer functions in the pair of second filter means is varied depending on an output from the piezoelectric vibration gyro.

5. The audio processing apparatus according to claim 3, wherein the detection means for detecting the rotational movement of the head of the listener wearing the headphone is a geomagnetic azimuth sensor, and the uncorrelated processing corresponding to the respective predetermined transfer functions in the pair of second filter means is varied depending on an output from the geomagnetic azimuth sensor.

6. An audio processing apparatus for a headphone comprising:

first filter means for processing n-channel audio signals in accordance with predetermined finite impulse response characteristics and having a predetermined limited number of delay stages so as to preclude reflective sound components from being produced and for converting the n-channel (where n is a positive integer greater than or equal to 2) audio signals supplied from at least one signal source into a first channel signal and a second channel signal by mixing processed portions of the n-channel audio signals;

a pair of second filter means, one second filter means having a first predetermined transfer function including reflective sound components and receiving the first channel signal and the other second filter means having a second predetermined transfer function different than said first predetermined transfer function and including reflective sound components and receiving the second channel signal output from the first filter means for providing an uncorrelated independent processing by setting different delay times corresponding to said first and second predetermined transfer functions to the first channel signal and the second channel signal, respectively wherein the first channel signal remains separate from and unmixed with the second channel signal; and an output unit for respectively supplying signals output from the pair of second filter means to left and right loudspeaker units of the headphone, wherein the pair of second filter means each comprise a digital filter providing uncorrelated processing by setting delay times corresponding to the respective first and second predetermined transfer functions relating to reflective sound components using a delay unit for outputting a plurality of delay times, a multiplier for setting each delay time output to an arbitrary value, and an adder for adding each multiplier output.

* * * * *